US007264556B1

(12) United States Patent
Divisconti

(10) Patent No.: US 7,264,556 B1
(45) Date of Patent: Sep. 4, 2007

(54) COLLAPSIBLE GOLF CLUB

(76) Inventor: Stephen Divisconti, 838 Frankford Road, West Babylon, NY (US) 11704

( * ) Notice: Subject to any disclaimer, the term of this patent is extended or adjusted under 35 U.S.C. 154(b) by 0 days.

(21) Appl. No.: 11/289,791

(22) Filed: Nov. 30, 2005

(51) Int. Cl.
*A63B 53/00* (2006.01)
*F16B 2/02* (2006.01)

(52) U.S. Cl. ..... 473/296; 403/314

(58) Field of Classification Search ..... 473/296, 473/288, 306–307, 239, 297–299; 403/314, 403/334, 367–371, 373, 378, DIG. 4, 354
See application file for complete search history.

(56) References Cited

U.S. PATENT DOCUMENTS

| | | | | |
|---|---|---|---|---|
| 1,918,583 | A * | 7/1933 | Bear | 403/202 |
| 3,316,951 | A | 5/1967 | Jacobson | |
| 3,516,697 | A * | 6/1970 | Hahn | 403/118 |
| 3,829,092 | A | 8/1974 | Arkin | |
| 4,091,977 | A | 5/1978 | Luttbeg | |
| 4,340,227 | A * | 7/1982 | Dopkowski | 473/288 |
| 4,375,847 | A | 3/1983 | Picco | |
| 4,664,382 | A * | 5/1987 | Palmer et al. | 473/288 |
| 4,852,782 | A * | 8/1989 | Wu et al. | 224/661 |
| 5,433,442 | A | 7/1995 | Walker | |
| 5,792,006 | A | 8/1998 | Hesser | |
| 5,863,260 | A | 1/1999 | Butler, Jr. et al. | |
| 6,371,865 | B1 * | 4/2002 | Magliulo | 473/256 |
| 6,371,866 | B1 | 4/2002 | Rivera | |

* cited by examiner

*Primary Examiner*—Stephen Blau
(74) *Attorney, Agent, or Firm*—Richard L. Miller

(57) ABSTRACT

A collapsible golf club. A head is disposed on a shaft and a coupling replaceably couples an end of the handle to an end of the shaft. The coupling includes a threaded portion extending from the end of the shaft, a stub shaft extending from the threaded portion, a pair of pins extending radially outwardly from the stub shaft, a tube extending from the end of the handle and having a pair of slots and a shoulder, and a sleeve having an internal threaded portion and terminating in a lip. The tube is rotatably captured in the sleeve, up against the internal threaded portion, and is maintained therein by the lip providing a stop for the shoulder, thereby rotatably attaching the sleeve to the tube. The stub shaft passes through the internal threaded portion and into the tube, with the pair of pins entering the pair of slots, with the internal threaded portion threadably engaging the threaded portion, and with the sleeve being rotated until the pair of pins snug into the pair of slots, thereby providing a tight joint between the shaft and the handle.

13 Claims, 2 Drawing Sheets

COLLAPSIBLE GOLF CLUB

BACKGROUND OF THE INVENTION

1. Field of the Invention

The present invention relates to a golf club, and more particularly, the present invention relates to a collapsible golf club 2. Description of the Prior Art Numerous innovations for golf club related devices been provided in the prior art that will be described. Even though these innovations may be suitable for the specific individual purposes to which they address, however, they differ from the present invention.

A FIRST EXAMPLE, U.S. Pat. No. 3,316,951, Issued on May 2, 1967, to JACOBSON teaches in combination, a golf bag having a normally closed bottom end and an open opposite end from which golf clubs extend, and a longitudinally extending shoulder strap having a separated opposite end portions attached to the bag, and a case enclosing said golf bag and clubs comprising: opposed flexible panels each having opposite longitudinal edges and end edges, one of the longitudinal and one of the end edges of one of the panels being secured to the corresponding edges of the other panel, the other longitudinal edge and the other end edge of each panel having a single zipper stringer extending therealong, the zipper stringers being normally interlocked to close the case around the golf bag, two cooperating pairs of zipper sliders on said zipper stringers for selectively opening and closing said stringers on movement of the pairs of sliders in one direction, the leading slider of each pair opening the stringers and the other slide of each pair closing the stringers, each cooperating pair of sliders being positioned with its individual sliders on opposite sides of a different one of the end portions of the shoulder strap of the golf bag and defining the margins of a variably sized and shiftable opening on the stringers for the shoulder strap, through which opening the associated end portion of the shoulder strap passes to the outside of the case, the slider nearest the end of the golf bag being movable to the end of the stringers at the end edges of the casing panels to form a large opening at the end of the casing around the open end of the golf bag, said cooperating pair of zipper sliders being movable into a contiguous position when the shoulder strap is tucked into the casing where the stringers are closed for substantially their full length, and means on the sliders which permit the four sliders to be locked together in such position.

A SECOND EXAMPLE, U.S. Pat. No. 3,829,092, Issued on Aug. 13, 1974, to ARKIN teaches in combination, a portable container with a plurality of different golf club heads with each of the heads having a shank portion, said plurality of different golf club heads all removably supported in said portable container, means in the container such as pegs or the like for removably and spacedly supporting the heads whereby said heads are each independently removable from the container, and a shaft formed of a plurality of telescoping sections adapted when in extended position to form a shaft for each of the golf club heads, the shaft having an innermost section, an intermediate section and an outermost section, which outermost section forms the handle of said shaft, each of the shanks of the golf club heads having means which cooperate with the innermost section of the shaft for detachably locking said shaft to any one of said heads for using same as a conventional golf club, the said telescoping sections when detached from any of said heads to be telescoped so that all of the telescoped sections are collapsed to a relatively short length to be readily supported in the portable container, means in the container for retaining the telescoped sections in said container, said single shaft and plurality of different detachable heads forming the equivalent of a complete set of different golf clubs which are transportable in the relatively small container.

A THIRD EXAMPLE, U.S. Pat. No. 4,091,977, Issued on May 30, 1978, to LUTTBEG teaches a protective carrier for golf bags and golf clubs comprising a tapered, tubular shaped, rigid container having hinged clam shell halves permitting the container to be opened and closed, and a lock and latches to secure the halves. A longitudinal reinforced slot is provided in the container wall to allow the extension of a golf bag handle and golf bag strap through the container to permit carrying of the container and a golf bag therein. A latch strap across the slot prevents the golf bag strap and handle from becoming inaccessible by receding into the interior of the container. Reinforcement ribs can be provided around the slot. The carrier has closed ends formed of hemispherical sections. Supporting ribs can extend longitudinally along the interior of the carrier, or can be arcuate shaped and extended transversely along the interior of the carrier. An alternative embodiment comprises a solid conical shaped slotted tube with an openable plug end and a permanently closed end.

A FOURTH EXAMPLE, U.S. Pat. No. 4,375,847, Issued on Mar. 8, 1983, to PICCO teaches a portable golf equipment case for carrying a knockdown golf bag, clubs, and golf accessories comprising an oblong box-like structure having broad side walls generally in the shape of a parallelogram and including a body portion and a hinged lid forming a major portion of one of the broad side walls. A roller member is located at one diagonal end of the parallelogram type structure with the roller running substantially across the width of the relatively narrow side and end walls to provide a relatively wide load bearing surface for pulling the case from the opposite diagonal end of the structure which includes a flush mounted handle. A second flush mounted handle is located substantially at the mid section of one side wall for lifting and carrying the case. Means are also selectively located on the side wall containing the flush handle for attaching a carrying strap thereto.

A FIFTH EXAMPLE, U.S. Pat. No. 5,433,442, Issued on Jul. 18, 1995, to WALKER teaches a golf club with a quick release head comprising a shaft which has an upper handle end a lower hosel end formed in a tubular configuration. The hosel end has a bore centrally formed therein. Screw threads formed within the bore extend from the hosel end of the shaft inwardly a predetermined distance. A head at the lower head end has an upwardly extending hosel at the hosel end and a bore formed within the hosel end. The interior diameter of the bore of the hosel is essentially the same as the internal bore in the shaft and the exterior diameter of the hosel is essentially the same as the exterior diameter of the shaft at the hosel end. The hosel has a diametric aperture which extends therethrough. A coupling rod has a threaded upper end with screw threads matable with the screw threads in the bore of the shaft and a lower end formed with a diametric aperture extends therethrough in alignment with the diametric aperture in the hosel. A quick release pin is positionable through the apertures of the hosel and rod to secure a preselected head in operative association with the rod and shaft.

A SIXTH EXAMPLE, U.S. Pat. No. 5,792,006, Issued on Aug. 11, 1998, to HESSER teaches a collapsible golf club shaft that is formed of a conventional stepped one-piece tubular golf shaft having diameters progressing from a large ID and OD end to a smaller ID and OD end, being cut in two at the end of one cylindrical axial sections next to the larger axial section, allowing the two pieces to be telescoped together as inner and outer pieces, and shifted then between a collapsed position compactly nested together and an extended operative position with only endmost stepped sections of the pieces yet overlapped at a separable connection between the pieces. A screw can be extended through wall structure openings and threaded into a reinforcing structure inside the inner piece at the connection for locking the pieces together in the extended operative position. A golf club formed from this shaft, with a hand grip on the outer piece and a head on the inner piece, at the opposite ends of the extended shaft, can be collapsible to slightly more than half the length of the extended operative club, for compact storage and handling.

A SEVENTH EXAMPLE, U.S. Pat. No. 5,863,260, Issued on Jan. 26, 1999, to BUTLER, JR ET AL. teaches a device-coupled golf club including a club head which is assembled with a shaft by use of a coupling device. Club head is formed with a hosel which is formed with a bore having threads formed in an upper portion thereof and a floor at the base thereof. Coupling device is formed with a body having a bore formed axially therethrough. A flange is formed radially outwardly from one end of the body and is formed with threads from the flange toward the opposite axial end of the body. A ferrule is located on shaft and a tip end of the shaft is inserted into bore of body and secured there by an epoxy glue. An exterior surface of body is formed with threads which engage threads formed within bore of hosel to removably secure device with head whereby shaft is assembled with the head to form club.

AN EIGHTH EXAMPLE, U.S. Pat. No. 6,371,866 B1, Issued on Apr. 16, 2002, to RIVERA teaches a compact golf club set having a complete set of thirteen golf club heads, two club shafts, and two club handles, all attractively positioned and retained, in a unique briefcase-style carrying case, which provides ready access to golf shoes, towels, balls and tees. The various club shafts and club handles combine to form a long and a short club assembly, corresponding with a typical wood and a typical putter, respectively. The club shafts couple directly to the club heads without an intervening shank, which allows a complete thirteen club head set to be compactly and efficiently positioned in receptacles in the carrying case.

It is apparent that numerous innovations for golf club related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, it is an object of the present invention to provide a collapsible golf club that avoids the disadvantages of the prior art.

Briefly stated, another object of the present invention is to provide a collapsible golf club. A head is disposed on a shaft and a coupling replaceably couples an end of the handle to an end of the shaft. The coupling includes a threaded portion extending from the end of the shaft, a stub shaft extending from the threaded portion, a pair of pins extending radially outwardly from the stub shaft, a tube extending from the end of the handle and having a pair of slots and a shoulder, and a sleeve having an internal threaded portion and terminating in a lip. The tube is rotatably captured in the sleeve, up against the internal threaded portion, and is maintained therein by the lip providing a stop for the shoulder, thereby rotatably attaching the sleeve to the tube. The stub shaft passes through the internal threaded portion and into the tube, with the pair of pins entering the pair of slots, with the internal threaded portion threadably engaging the threaded portion, and with the sleeve being rotated until the pair of pins snug into the pair of slots, thereby providing a tight joint between the shaft and the handle.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

Figure 2:
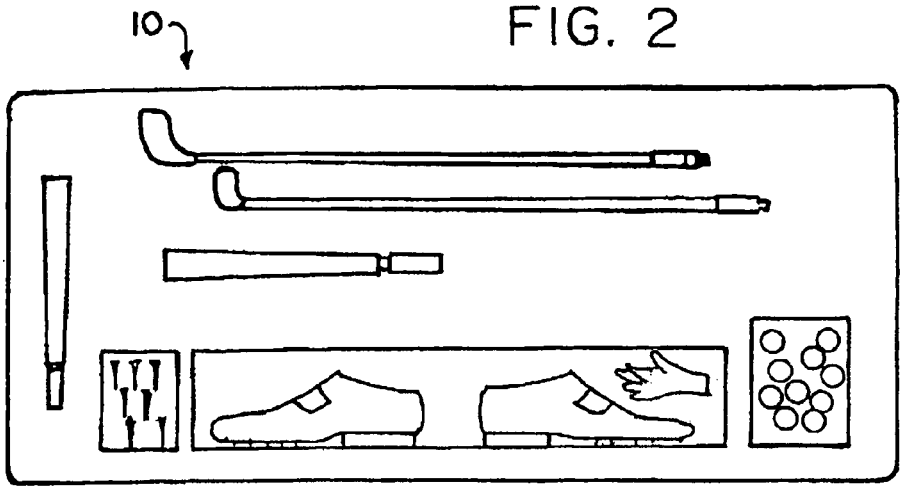
FIG. 2 is an enlarged diagrammatic top plan view taken generally in the direction of ARROW 2 in FIG. 1.

10 collapsible golf club of present invention
12 shaft
14 handle
16 head
18 coupling
20 end of handle 14
22 end of shaft 12
24 threaded portion of coupling 18
26 stub shaft of coupling 18
28 pair of pins of coupling 18
30 tube of coupling 18
32 terminal portion of tube 30 of coupling 18
34 remaining portion of tube 30 of coupling 18
36 shoulder around terminal portion 32 of tube 30 of coupling 18
38 pair of slots in terminal portion 32 of tube 30 of coupling 18
40 sleeve of coupling 18
42 inner portion of sleeve 40 of coupling 18
44 outer portion of sleeve 40 of coupling 18
46 internal threaded portion of sleeve 40 of coupling 18
48 lip of inner portion 42 of sleeve 40 of coupling 18
50 reduced opening of inner portion 42 of sleeve 40 of coupling 18

DETAILED DESCRIPTION OF THE PREFERRED EMBODIMENT

Figure 1:
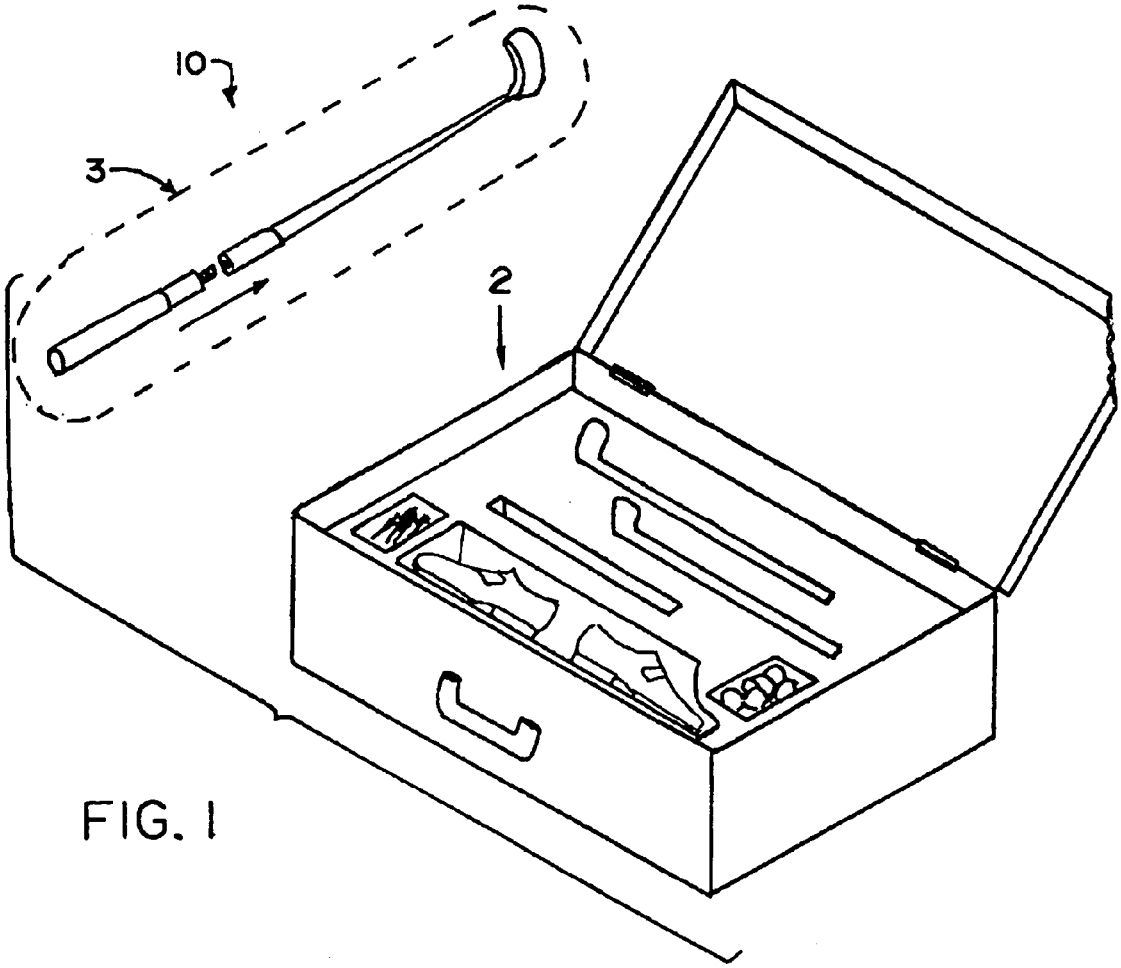
FIG. 1 is a diagrammatic perspective view of the collapsible golf club of the present invention stored in a typical case.

Referring now to the figures, in which like numerals indicate like parts, and particularly to FIGS. 1 and 2, which are, respectively, a diagrammatic perspective view of the collapsible golf club of the present invention stored in a typical case, and, an enlarged diagrammatic top plan view taken generally in the direction of ARROW 2 in FIG. 1, the collapsible golf club of the present invention is shown generally at 10.

Figure 3:
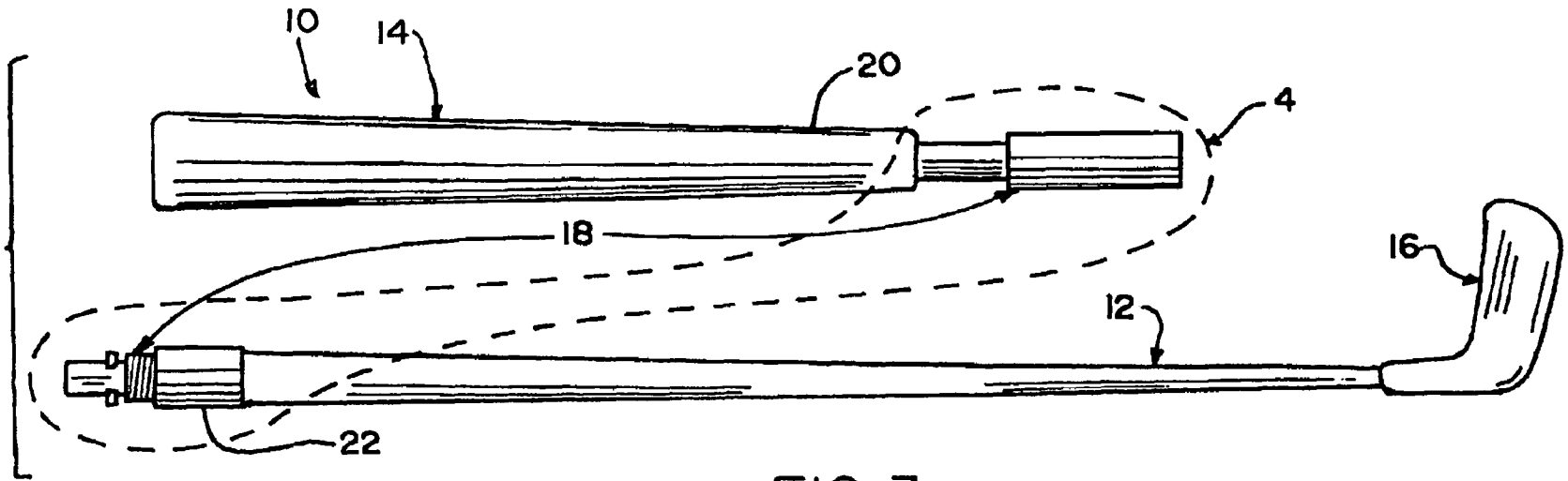
FIG. 3 is an enlarged exploded diagrammatic side elevational view of the area generally enclosed by the dotted curve identified by ARROW 3 in FIG. 1 of the collapsible golf club of the present invention.

The configuration of the collapsible golf club 10 can best be seen in FIG. 3, which is an enlarged exploded diagrammatic side elevational view of the area generally enclosed by the dotted curve identified by ARROW 3 in FIG. 1 of the collapsible golf club of the present invention, and as such, will be discussed with reference thereto.

The collapsible golf club 10 comprises a shaft 12, a handle 14, a head 16, and a coupling 18. The head 16 is disposed on the shaft 12. The coupling 18 replaceably couples an end 20 of the handle 14 to an end 22 of the shaft 12.

Figure 4:
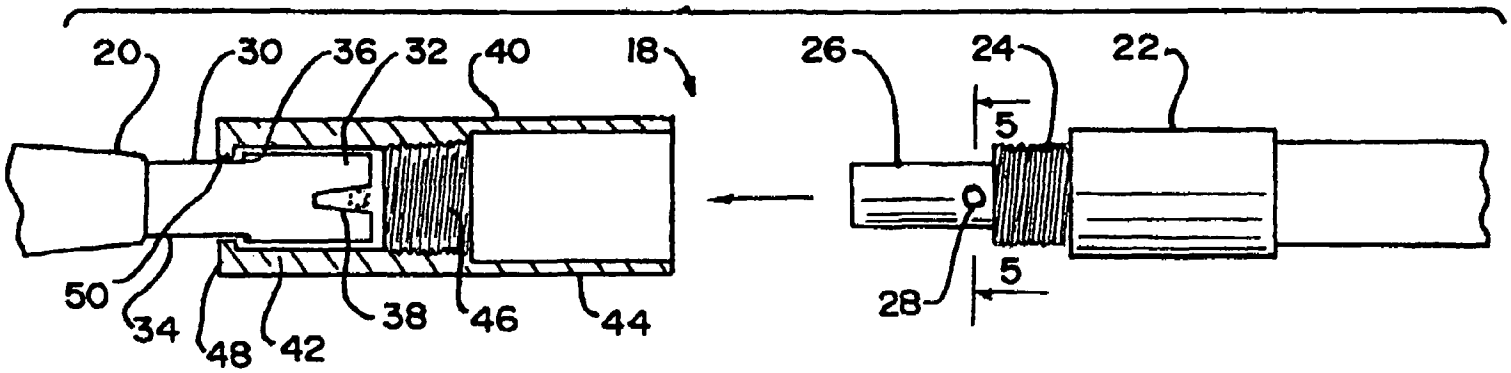
FIG. 4 is an enlarged diagrammatic side elevational view in partial section of the area generally enclosed by the dotted curve identified by ARROW 4 in FIG. 3 of the joint of the collapsible golf club of the present invention.
Figure 5:
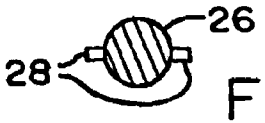
FIG. 5 is a diagrammatic cross sectional view taken along LINE 5-5 in FIG. 4.

The configuration of the joining apparatus 18 can best be seen in FIGS. 4 and 5, which are, respectively, an enlarged diagrammatic side elevational view in partial section of the area generally enclosed by the dotted curve identified by ARROW 4 in FIG. 3 of the joint of the collapsible golf club of the present invention, and, a diagrammatic cross sectional view taken along LINE 5-5 in FIG. 4, and as such, will be discussed with reference thereto.

The coupling 18 comprises a threaded portion 24. The threaded portion 24 of the coupling 18 extends collinearly from, and is smaller in diameter than, the end 22 of the shaft 12.

The coupling 18 further comprises a stub shaft 26. The stub shaft 26 of the coupling 18 extends collinearly from, and is smaller in diameter than, the threaded portion 24 of the coupling 18.

The coupling 18 further comprises a pair of pins 28. The pair of pins 28 of the coupling 18 extend radially outwardly from the stub shaft 26 of the coupling 18 and are diametrically opposed to each other.

The coupling 18 further comprises a tube 30. The tube 30 of the coupling 18 extends collinearly from, and is smaller in diameter than, the end 20 of the handle 14.

The tube 30 of the coupling 18 has a terminal portion 32. The terminal portion 32 of the tube 30 of the coupling 18 is larger in diameter than a remaining portion 34 of the tube 30 of the coupling 18 so as to provide a shoulder 36 around the tube 30 of the coupling 18.

The terminal portion 32 of the tube 30 of the coupling 18 has a pair of slots 38. The pair of slots 38 in the terminal portion 32 of the tube 30 of the coupling 18 are diametrically opposed to each other, and each of which converge axially therein.

The coupling 18 further comprises a sleeve 40. The sleeve 40 of the coupling 18 is divided into an inner portion 42 and an outer portion 44 by an internal threaded portion 46.

The inner portion 42 of the sleeve 40 of the coupling 18 terminates in a lip 48. The lip 48 of the inner portion 42 of the sleeve 40 of the coupling 18 extends inwardly therearound so as to provide a reduced opening 50 thereat.

The remaining portion 34 of the tube 30 of the coupling 18 passes into the reduced opening 50 of the inner portion 42 of the sleeve 40 of the coupling 18, and the terminal portion 32 of the tube 30 of the coupling 18 is rotatably captured in the inner portion 42 of the sleeve 40 of the coupling 18, up against the internal threaded portion 46 in the sleeve 40 of the coupling 18, and is maintained therein by the lip 48 of the inner portion 42 of the sleeve 40 of the coupling 18 providing a stop for the shoulder 36 of the terminal portion 32 of the tube 30 of the coupling 18, thereby rotatably attaching the sleeve 40 of the coupling 18 to the tube 30 of the coupling 18.

The stub shaft 26 of the of the coupling 18 passes through the outer portion 44 of the sleeve 40 of the coupling 18, through the internal threaded portion 46 in the sleeve 40 of the coupling 18, and into the tube 30 of the coupling 18, with the pair of pins 28 of the coupling 18 entering the pair of slots 38 in the terminal portion 32 of the tube 30 of the coupling 18, with the internal threaded portion 46 in the sleeve 40 of the coupling 18 threadably engaging the threaded portion 24 of the coupling 18, and with the sleeve 40 of the coupling 18 being rotated until the pair of pins 28 of the coupling 18 snug into the pair of slots 38 in the terminal portion 32 of the tube 30 of the coupling 18, thereby providing a tight joint between the shaft 12 and the handle 14.

It will be understood that each of the elements described above, or two or more together, may also find a useful application in other types of constructions differing from the types described above.

While the invention has been illustrated and described as embodied in a collapsible golf club, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A collapsible golf club, comprising:

a) a shaft;

b) a handle;

c) a head; and d) a coupling;

wherein said head is disposed on said shaft;

wherein said coupling replaceably couples an end of said handle to an end of said shaft;

wherein said coupling comprises a threaded portion;

wherein said coupling comprises a stub shaft;

wherein said coupling comprises a pair of pins;

wherein said pair of pins of said coupling extend radially outwardly from said stub shaft of said coupling;

wherein said pair of pins of said coupling are diametrically opposed to each other;

wherein said coupling comprises a tube;

wherein said tube of said coupling has a terminal portion;

wherein said terminal portion of said tube of said coupling is larger in diameter than a remaining portion of said tube of said coupling so as to provide a shoulder around said tube of said coupling;

wherein said terminal portion of said tube of said coupling has a pair of slots;

wherein said pair of slots in said terminal portion of said tube of said coupling are diametrically opposed to each other;

wherein each slot is defined by a pair of walls;

wherein said pair of walls defining each slot both converge axially in said terminal portion of said tube of said coupling;

wherein said coupling comprises a sleeve;

wherein said sleeve of said coupling has an inner portion;

wherein said sleeve of said coupling has an outer portion;

wherein said sleeve of said coupling has an internal threaded portion;

wherein said internal threaded portion of said sleeve of said coupling divides said sleeve of said coupling into a threadless said inner portion of said sleeve of said coupling and into a threadless said outer portion of said sleeve of said coupling; and wherein said stub shaft of said coupling passes through said outer portion of said sleeve of said coupling, through said internal threaded portion in said sleeve of said coupling, and into said tube of said coupling, with said pair of pins of said coupling entering said pair of slots in said terminal portion of said tube of said coupling, with said internal threaded portion in said sleeve of said coupling threadably engaging said threaded portion of said coupling, and with said sleeve of said coupling being rotated until said pair of pins of said coupling snug into said pair of slots in said terminal portion of said tube of said coupling, thereby providing a tight joint between said shaft and said handle.

2. The club of claim 1, wherein said threaded portion of said coupling extends from said end of said shaft.

3. The club of claim 2, wherein said threaded portion of said coupling extends collinearly from said end of said shaft.

4. The club of claim 2, wherein said threaded portion of said coupling is smaller in diameter than said end of said shaft.

5. The club of claim 1, wherein said stub shaft of said coupling extends from said threaded portion of said coupling.

6. The club of claim 1, wherein said stub shaft of said coupling extends collinearly from said threaded portion of said coupling.

7. The club of claim 1, wherein said stub shaft of said coupling is smaller in diameter than said threaded portion of said coupling.

8. The club of claim 1, wherein said tube of said coupling extends from said end of said handle.

9. The club of claim 1, wherein said tube of said coupling extends collinearly from said end of said handle.

10. The club of claim 1, wherein said tube of said coupling is smaller in diameter than said end of said handle.

11. The club of claim 1, wherein said inner portion of said sleeve of said coupling terminates in a lip.

12. The club of claim 11, wherein said lip of said inner portion of said sleeve of said coupling extends inwardly therearound so as to provide a reduced opening thereat.

13. The club of claim 12, wherein said remaining portion of said tube of said coupling passes into said reduced opening of said inner portion of said sleeve of said coupling, and said terminal portion of said tube of said coupling is rotatably captured in said inner portion of said sleeve of said coupling, up against said internal threaded portion in said sleeve of said coupling, and is maintained therein by said lip of said inner portion of said sleeve of said coupling providing a stop for said shoulder of said terminal portion of said tube of said coupling, thereby rotatably attaching said sleeve of said coupling to said tube of said coupling.

* * * * *